United States Patent [19]

Curtinot et al.

[11] 4,376,923

[45] Mar. 15, 1983

[54] ULTRA-HIGH FREQUENCY TUNING DEVICE OF THE SLIDING CONTACT TYPE

[75] Inventors: Jean C. Curtinot; Xavier Delestre; Jean Fouillet, all of Paris, France

[73] Assignee: Thomson-CSF, Paris, France

[21] Appl. No.: 240,286

[22] Filed: Mar. 4, 1981

[30] Foreign Application Priority Data

Mar. 5, 1980 [FR] France ..... 80 04949

[51] Int. Cl.[3] ..... H01P 7/06; H01P 1/207

[52] U.S. Cl. ..... 333/232; 333/209; 333/253

[58] Field of Search ..... 333/231–235, 333/208–209, 253, 222, 223, 224, 239

[56] References Cited

FOREIGN PATENT DOCUMENTS 1280996 10/1968 Fed. Rep. of Germany .

OTHER PUBLICATIONS

Schrenk et al.–"Tuning Stubs as an Aid to Coupling RF Energy to Electrodeless Discharge Lamps", applied Spectroscopy, vol. 26, No. 1, 1972, pp. 108–110.

*Primary Examiner*—Marvin Nussbaum

*Attorney, Agent, or Firm*—Cushman, Darby & Cushman

[57] ABSTRACT

The tuning device comprises a hollow cylindrical part and a moving rod which penetrates a cavity by passing from one side to the other of the hollow cylindrical member. This cylindrical member is fixed and integral with the cavity. It has an end located within the cavity, the end being longitudinally cut to form n slots (n being an integer greater than 1) for forming n elastic members, which are covered with an electrolytic silver deposit. Joined silver contacts are welded to the end of the elastic members to provide the contact with the moving rod and prevent poor conduction of surface currents due to wear to the electrolytic deposit at the contacts.

3 Claims, 2 Drawing Figures

ULTRA-HIGH FREQUENCY TUNING DEVICE OF THE SLIDING CONTACT TYPE

BACKGROUND OF THE INVENTION

The present invention relates to an ultra-high frequency tuning device incorporating a part which is fixed relative to the wall of a cavity and a moving part which slides within the fixed part so that it can more or less deeply penetrate the said cavity. A good quality electrical contact between the fixed part and the moving part must ensure the passage of surface currents between these two parts.

Such devices are known, e.g. from U.S. Pat. No. 2,556,607 in which elastic plates fixed to one of the parts ensures a sliding contact with the other part. These plates are made from materials having a good elasticity but, as a result, are hard, fragile, abrasive and poor conductors of electricity. To obviate these defects it is known to cover such elastic plates with a deposit of silver or gold by electrolysis, which is a good conductor of the ultra-high frequency currents forming the surface currents. However, since for mechanical strength reasons, the moving part must be made from a metal whose hardness is greater than that of silver or gold, the repeated displacements of the moving part within the fixed part bring about a rapid deterioration of the surface state, i.e. of the gold or silver deposit, due to friction. This is the case, for example, when such a device is used in a frequency-mobile filter, i.e. in a filter which has to operate in several frequency ranges or channels and which must be able to pass rapidly from one range or channel to another. This rapid deterioration of the surface state leads on the one hand to a progressive reduction in the quality of the filter with, in particular, an increase of losses and the appearance of "undesired noise" during tuning changes and on the other hand to a limited service life.

BRIEF SUMMARY OF THE INVENTION

The invention aims at providing a good electrical contact between the fixed part and the moving part of the device, even when the moving part moves.

The present invention therefore relates to an ultra-high frequency tuning device for fitting in a wall of a cavity, having a moving cylindrical rod with a sliding surface and a hollow cylindrical member fixed to the cavity wall, terminated by n elastic members (n being an integer at least equal to 2) and within which slides the rod whilst passing from one side to the other thereof in order to penetrate the cavity by a regulatable length, the elastic members having contacts bearing on the sliding surface, the cylindrical member having an end in which there are n longitudinal slots defining, between them, n plates, the elastic members incorporating the n plates and n joined members made from a metal which is a good conductor of electricity, respectively associated with the n plates and forming contacts.

In addition, U.S. Pat. No. 2,561,727 discloses a tuning device for a triode in which a hollow cylindrical member has a longitudinally split end for forming elastic plates to which are connected contacts. This hollow cylindrical member moves, passing through one triode wall and then surrounding by its end provided with the plates the triode anode which is fixed to the opposite wall. However, this device does not make it possible to regulate the penetration of a tuning rod into a cavity, because the triode anode which could be likened to a rod is fixed and is integral with a wall opposite that traversed by the hollow cylindrical member. Furthermore, the anode does not traverse the hollow cylindrical member.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
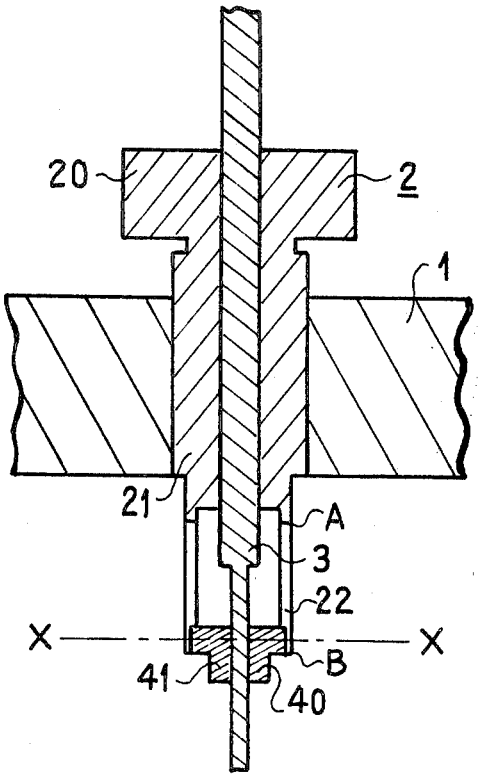
FIG. 1 a part sectional view of a filter incorporating a device according to the invention.

FIG. 1 is a part sectional view of a frequency-mobile filter. FIG. 1 shows the wall 1 of a cavity. This wall is perforated by a cylindrical hole of diameter 11 mm into which is fitted a tuning device. The tuning device comprises a hollow cylindrical member 2 forming a clamp, within which slides a solid brass cylindrical rod 3.

Clamp 2 has a cylindrical head 20, of external diameter 20 mm and positioned outside the cavity. It also has a median portion 21 with the same diameter as the hole made in the cavity wall and a terminal portion 22 constituted by a cylinder with an external diameter 9 mm. Whilst the head 20 and the median portion 21 have a significant wall thickness, the terminal portion 22 is a thin-walled hollow cylinder, which is longitudinally slotted over the length AB forming four parallel slots at 90° from one another. The clamp 2 is made from beryllium bronze and as a result of a treatment to be described hereinafter, the four plates defined by the four slots are made elastic.

In conventional devices these elastic plates are covered with a gold or silver deposit and bear directly against the cylindrical rod. As stated hereinbefore friction due to the displacement of the rod, leads to the rapid wear of the gold or silver coating and finally leads to the filter being taken out of use.

As shown in FIG. 1 joined members such as 40, 41 are inserted between the elastic plates and rod 3. These joined members, made from silver are fixed to the elastic plates and come into contact with rod 3.

Clamp 2 is made in the following way. A beryllium bronze blank is produced and is mechanically re-treated so as to attain the desired dimensions, particularly with regard to the external diameter of the median portion. A silver ring is joined by brazing to the free end of the terminal portion 22 of clamp 2. The terminal portion is then cut by means of a very fine milling cutter giving a slot width of 3/10 mm. A setting jig formed by a cylindrical centering pin of diameter 1.6 mm is introduced into the hole of the split ring in which slides rod 3. It should be noted that the diameter of the setting jig is slightly smaller than the diameter of the portion of rod 3 which slides in clamp 2, so as to ensure a good tightening of the rod between the clamp ends. Hooping produced by means of a metal band makes it possible to keep the ends of clamp 2 in contact with the jig. The assembly constituted by clamp 2, the jig and the hooping band is introduced for two hours into an enclosure at 320° C. This conventional heat treatment is intended to give the desired elasticity to the plates of clamp 2. The clamp is then covered by electrolysis with a silver deposit of thickness 7 microns.

When manufactured in this way there is no danger of the clamp rendering the tuning device unusable as a result of rapid wear with respect to the sliding contacts. Thus, the admissible wear at the contacts is no longer a few microns as with the conventional devices, where, under the few microns thick electrolytic silver deposit, the wear leads to the appearance of a poor conducting metal at the end of the clamp in contact with the rod. The admissible wear is now a few tenths of a millimetre. Moreover, it should be noted that the wear to the joined members such as 40, 41 on the brass of rod 3 leads to a rubbing and polishing of the tuning device and consequently improves its operation. However, in the case of the prior art devices without joined members the wear to the silver, which is only present in the form of a thin electrolytic deposit, tends to form chips which are prejudicial to the satisfactory operation of the device.

Figure 2:
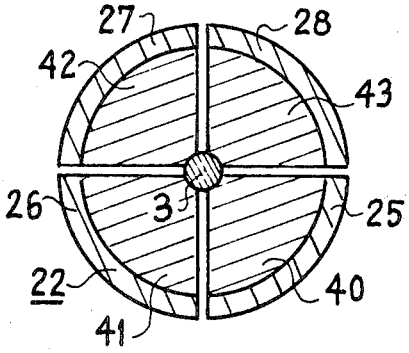
FIG. 2 a sectional view of the device of FIG. 1.

FIG. 2 is a sectional view along XX of the tuning device of FIG. 1. This view shows the moving rod 3, which, by the clearance of the four elastic plates 25 to 28 constituting end 22 of the clamp is secured between the clamp jaws. These jaws are formed by the four sections of the split ring, referred to in connection with FIG. 1. They are designated by reference numerals 40 to 43 in FIG. 2.

It should be noted that the joined member (40, 41 in FIG. 1) which makes contact, can be made not only of silver, but of any other metal or alloy which is a good conductor of electricity and relatively malleable so that, on wearing, it adapts to the sliding surface shape against which it comes into contact. This is the rubbing and polishing action referred to hereinbefore. Moreover, when said joined member has much larger dimensions than the sliding contact surface which it is required to ensure, it can be made by assembling two metal parts. One metal part must be a good conductor of the surface currents and relatively malleable at the sliding contact location, whilst the metal for the other metal part need only be chosen on the basis of its electrical conductivity.

What is claimed is:

1. An ultra-high frequency tuning device for fitting in a wall of a cavity comprising:

a first cylindrical member which runs through the wall of the cavity and which is adapted to be fixed to said wall, said first member being bored by a cylindrical hole having a first cylindrical aperture in the cavity and a second aperture outside the cavity, said first member terminating towards the first aperture in n elastic longitudinal members (n being an integer at least equal to 2);

n respective contacts made from a metal which is a good conductor of electricity and fixed to the elastic members, said n contacts being located between the elastic members and the first aperture and bounding the first aperture; and a second cylindrical member forming a moving rod for sliding through the hole and having a cylindrical part of the diameter of the first aperture, for sliding through the first aperture and penetrating the cavity by a regulatable length.

2. A tuning device according to claim 1, wherein the n contacts are portions of a ring.

3. A tuning device according to claim 1 or 2, wherein the n contacts are fixed to the elastic members by welding and the n elastic members are covered with an electrolytic deposit.

* * * * *